US006758701B2

(12) United States Patent
Kato

(10) Patent No.: US 6,758,701 B2
(45) Date of Patent: Jul. 6, 2004

(54) HIGH VOLTAGE TERMINAL

(75) Inventor: Yoshiaki Kato, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/238,228

(22) Filed: Sep. 10, 2002

(65) Prior Publication Data

US 2003/0049976 A1 Mar. 13, 2003

(30) Foreign Application Priority Data

Sep. 11, 2001 (JP) ..... 2001-275453

(51) Int. Cl.[7] ..... H01R 11/22
(52) U.S. Cl. ..... 439/852; 439/887
(58) Field of Search ..... 439/852, 924.1, 439/181, 186, 886, 887

(56) References Cited

U.S. PATENT DOCUMENTS 5,679,034 A * 10/1997 Hanazaki et al. ..... 439/845
5,707,259 A * 1/1998 Ishizuka et al. ..... 439/852
5,775,962 A * 7/1998 Kakuta et al. ..... 439/852
6,050,862 A * 4/2000 Ishii ..... 439/843
6,095,873 A * 8/2000 Muramatsu et al. ..... 439/852

* cited by examiner

*Primary Examiner*—Gary Paumen
(74) *Attorney, Agent, or Firm*—Crompton, Seager & Tufte, LLC

(57) ABSTRACT

An elongated hollow housing is made of a conductive material. The housing includes an opened first end for receiving the male terminal and a second end connected to the power supply. A first contactor made of a conductive material is located in the housing. The first contactor contacts the male terminal received into the housing. A second contactor made of a conductive material is located in the housing at a position closer to the first end than the first contactor is. The second contactor contacts the male terminal when the male terminal is inserted into the housing. The second contactor is deformed to separate from the male terminal after the male terminal is separated from the first contactor when the male terminal is removed from the housing.

11 Claims, 5 Drawing Sheets

HIGH VOLTAGE TERMINAL

BACKGROUND OF THE INVENTION

The present invention relates to a high voltage terminal used for wires on a vehicle.

In general, solderless terminals are often used for electrically connecting devices to one another in a vehicle.

A typical solderless terminal shown in FIG. 4(*a*) has a main body 40. A receptacle 41 is provided at one end of the main body 40. A lug 42 is provided at the other end of the main body 40. A pair of contactors 43, 44 are located in the receptacle 41 to face each other. When a prong 1 of a terminal is inserted in the receptacle 41, the contactors 43, 44 contact the prong 1. The lug 42 has a U-shaped cross-section with a bottom 42*b* and sidewalls projecting from the bottom 42. Two pairs of crimp pieces 45, 46 formed at the sidewalls. A wire 2 is placed in the U-shaped section. Then, the crimp pieces 45, 46 are bent toward the axis of the wire 2 to crimp the wire 2 to the lug 42. As a result, the wire 2 is electrically connected to the terminal main body 40. After the wire 2 is coupled, the main body 40 is fitted in one of sockets 51 of a female connector housing 50 shown in FIG. 5. The connector housing 50 is made of insulating resin. A prong 1 (not shown in FIG. 5) is located in each socket 51 of the connector housing 50. The terminal main body 40 is electrically connected to the corresponding prong 1.

In recent years, vehicles have an increasing load of electric devices. To deal with the capacitance of the electric loads, some vehicles are equipped with a 42V battery instead of conventionally used 14V batteries.

When the prong 1 is manually pulled out of the terminal main body 40 while the terminal is energized, continuous electric arc is generated between the prong 1 and the contactors 43, 44. Particularly, when the prong 1 and the terminal is connecting an electrical load to a high-voltage power supply, the arc is increased. The increased arc roughens the surfaces of the contactors 43, 44 and the prong 1. The roughened surfaces increase the contact resistance between the contactors 43, 44 and the prong 1. Thus, when energized, the contactors 43, 44 produce heat due to electrical resistance. Since the female connector housing 50 is made of insulating resin, the produced heat can damage the housing 50. Therefore, when the terminal main body 40 connects an electric load with a high-voltage power supply, the reliability of the main body 40 can deteriorate.

SUMMARY OF THE INVENTION

Accordingly, it is an objective of the present invention to provide a solderless high voltage terminal that prevents generation of arc between contactors and a prong of a male terminal.

To achieve the foregoing and other objectives and in accordance with the purpose of the present invention, a high-voltage terminal for connecting a high-voltage power supply with a male terminal extending from an electric component is provided. The high-voltage terminal includes an elongated hollow housing made of a conductive material, a first contactor mad of a conductive material, and a second contactor made of a conductive material. The housing includes an opened first end for receiving the male terminal, and a second end connected to the power supply. The first contactor is located in the housing. When the male terminal is inserted into the housing, the first contactor contacts the male terminal. The second contactor is located in the housing at a position closer to the first end than the first contactor is. When the housing receives the male terminal, the second contactor contacts the male terminal and is deformed by arc generated by the contact with the male terminal. When the male terminal is removed from the housing, the second contactor is deformed to separate from the male terminal after the male terminal is separated from the first contactor.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a cross-sectional view taken along line 1(*b*)—1(*b*) of FIG. 1(*a*);

FIG. 1(*c*) is an enlarged cross-sectional view of FIG. 1(*b*);

FIG. 3(*b*) is a cross-sectional view of the terminal shown in FIG. 1(*a*) when a first contactor is separated from the prong;

FIG. 3(*c*) is a cross-sectional view of the terminal shown in FIG. 2(*a*) when a second contactor is separated from the prong;

FIG. 4(*b*) is a cross-sectional view of the prior art solderless terminal of FIG. 4(*a*) when the prong is completely pulled out.

DETAILED DESCRIPTION OF THE PREFERRED EMBODIMENTS

A solderless terminal according to a preferred embodiment of the present invention will now be described with reference to FIGS. 1(*a*) to 3(*c*).

A main body 10 of the solderless terminal is formed by die-cutting a conductive metal plate into a predetermined shape and then bending predetermined sections. The metal for forming the terminal main body 10 is made of copper, a copper alloy, or other metal. As shown in FIGS. 1(*a*) and 1(*b*), the terminal main body 10 includes a lug 12 and a receptacle 11. The receptacle 11 has a rectangular cross-section and includes an upper wall 11*a*, a lower wall 11*b*, and sidewalls 11*c*, 11*d*. The receptacle 11 has an opening 11*e*, to which a prong 1 of a male terminal is inserted. The lug 12 has a U-shaped cross-section and includes a base portion 12*b* and sidewalls 12*c*, 12*d*.

Figure 2:
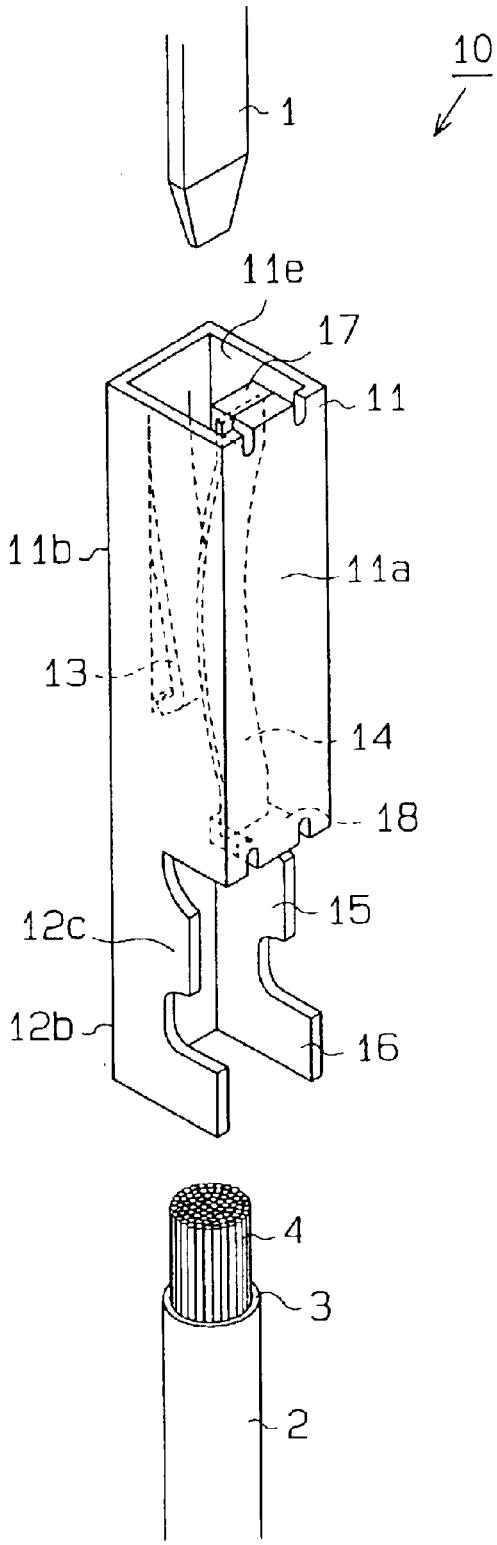
FIG. 2 is a perspective view of the terminal shown in FIG. 1(*a*)

As shown in FIG. 2, two pairs of holding pieces 15, 16 extend from the sidewalls 12*c*, 12*d*. The holding pieces 15, 16 are used for holding an electric wire 2. The holding pieces 15, 16 extend from the edges of the sidewalls 12*c*, 12*d* of the lug 12 in a direction parallel to the direction from the lower wall 11*b* to the upper wall 11*a*. Before being connected to the lug 12, the distal part of insulating coating 3 on the wire 2 is removed to expose a core 4. The wire 2 is placed directly above the base portion 12*b* of the lug 12. The holding pieces 15, 16 are bent toward the central axis of the terminal body 10 to crimp the wire 2 to the lug 12. In this state, the holding pieces 15 are pressed against the core 4. The holding pieces 16 are pressed against part of the wire 2 from which the coating 3 is not removed. Accordingly, the wire 2 is electrically connected with the terminal main body 10.

Figure 1:
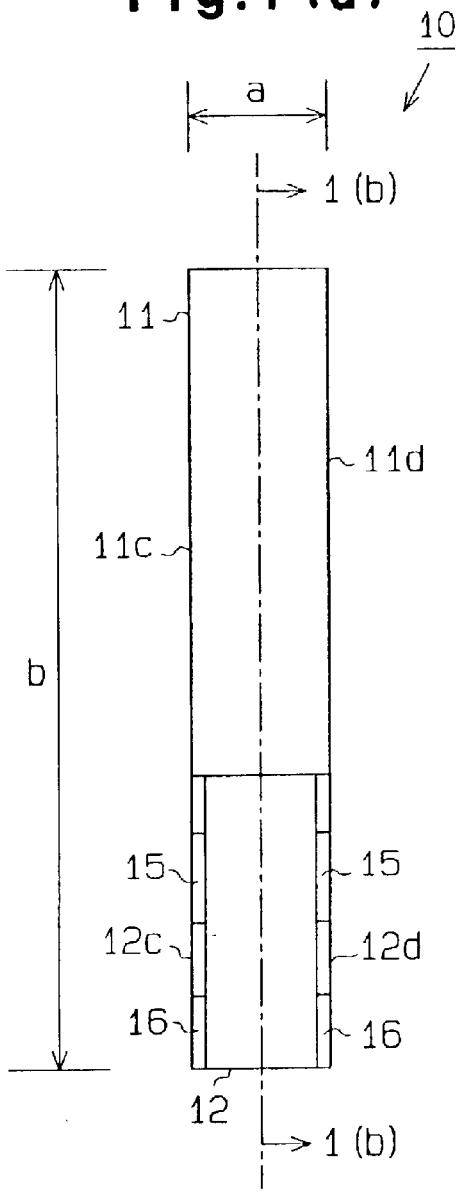
FIG. 1(*a*) is a plan view illustrating a solderless high voltage terminal according to a preferred embodiment of the present invention.
Figure 1:
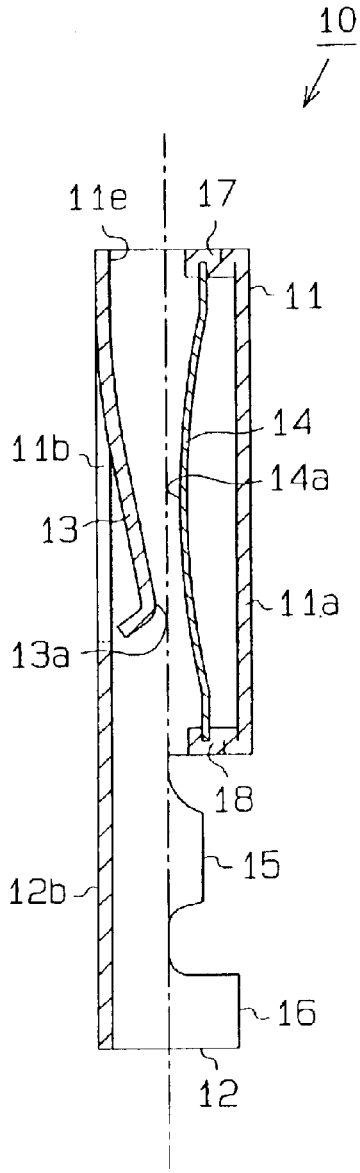
Figure 1:
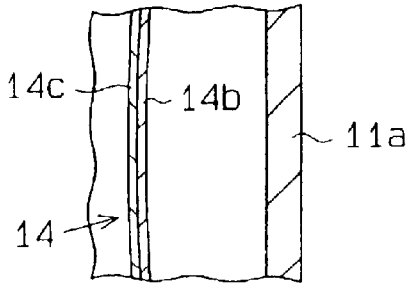

As shown in FIGS. 1(*b*) and 2, a main connecting member, which is a main contactor 13 in this embodiment, is located on the lower wall 11*b* of the receptacle 11. The main contactor 13 extends from a section near the opening 11*e* toward the lug 12. As shown in FIGS. 1(*a*) and 2, the main contactor 13 is a rectangular metal plate. The width of the contactor 13 is smaller than the width a of the opening 11*e*, and the length of the contactor 13 is smaller than the length b of the receptacle 11. Since the main contactor 13 is made of the same material as that of the terminal main body 10, the main contactor 13 is integrally formed with the lower wall 11*b* of the receptacle 11. The main contactor 13 is bent from the lower wall 11*b* toward the center axis of the main body 10. The distal end of the main contactor 13 is bent to form a curve toward the lower wall 11*b*. The peak of the distal curved portion of the main contactor 13 is a first contact point 13*a*.

As shown in FIGS. 1(*b*) and 2, an auxiliary connecting member, which is an auxiliary contactor 14 in this embodiment, is fixed to the upper wall 11*a* with supports 17, 18. As shown in FIGS. 1(*a*) and 2, the auxiliary contactor 14 is a rectangular metal plate. The width of the contactor 14 is smaller than the width a of the opening 11*e*, and the length of the contactor 14 is smaller than the length b of the receptacle 11. The thickness of the auxiliary contactor 14 is less than that of the metal plate forming the terminal main body 10. The auxiliary contactor 14 is formed like a diaphragm with its longitudinal center bulging toward the axis of the terminal main body 10. The peak of the bulge of the auxiliary contactor 14 is a second contact point 14*a*.

As shown in FIG. 1(*c*), the auxiliary contactor 14 is formed by bonding two different metals 14*b*, 14*c* together. The thermal expansion coefficient of the metal 14*c* is higher than that of the metal 14*b*. In general, an Ni—Fe based material is used as the low thermal expansion coefficient metal 14*b*, and Cu, Ni, Cu—Zn based material, Ni—Cu based material, or Ni—Cr—Fe based material is used as the high thermal expansion coefficient metal 14*c*. When supplied with electric current, the contactor 14 produces heat due to electrical resistance. In this state, since the high thermal expansion coefficient metal 14*c* expands at a greater rate, the contactor 14 is bent toward the side of the high thermal expansion coefficient metal 14*c*. In this embodiment, the auxiliary contactor 14 is bent away from the prong 1 of the male connector. This is because the high heat expansion coefficient metal is located at the side facing the prong 1, and the low heat expansion coefficient metal is located at the opposite side.

The auxiliary contactor 14 is made of metals different from that of the main body 10. Therefore, the auxiliary contactor 14, which is made of metals different from the main body 10, is fixed to the inner surface of the upper wall 11*a* with the supports 17, 18. As shown in FIG. 1(*b*), the supports 17, 18 are formed by bending the longitudinal ends of the upper wall 11*a* inward.

The operation of the solderless terminal main body 10 and the prong 1 of the male terminal will now be described.

Figure 3A:
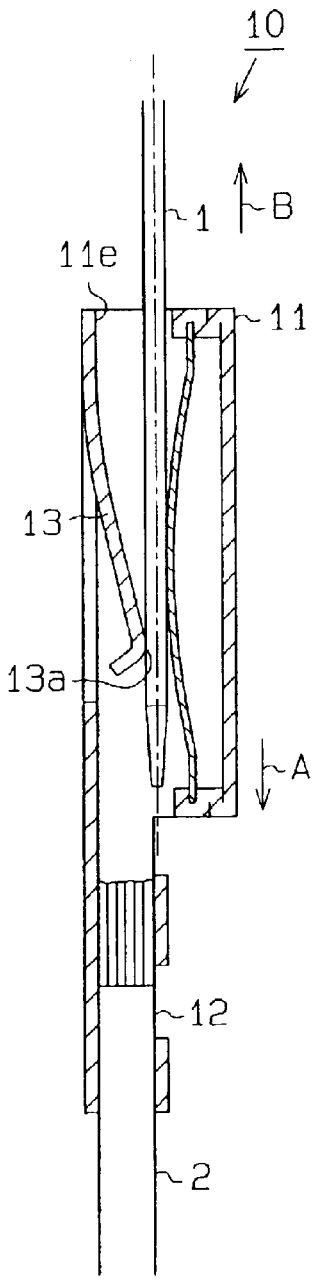
FIG. 3(*a*) is a cross-sectional view of the terminal shown in FIG. 1(*a*) when a prong of a male terminal is completely inserted.
Figure 3B:
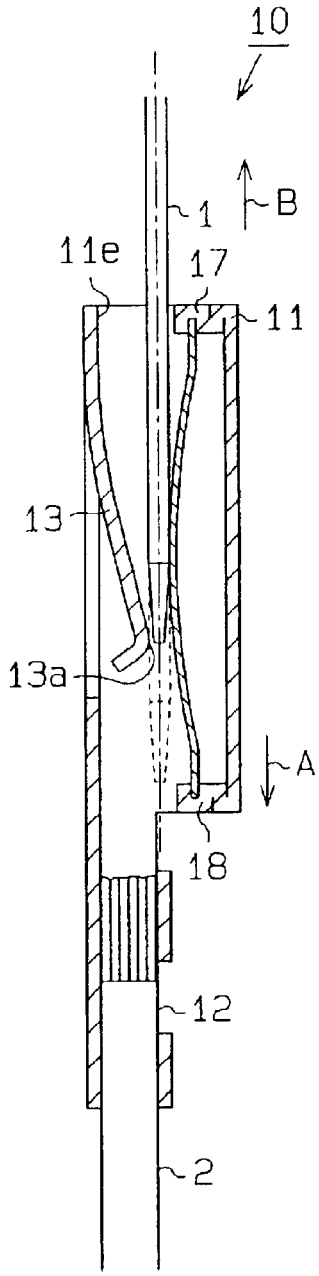
Figure 3C:
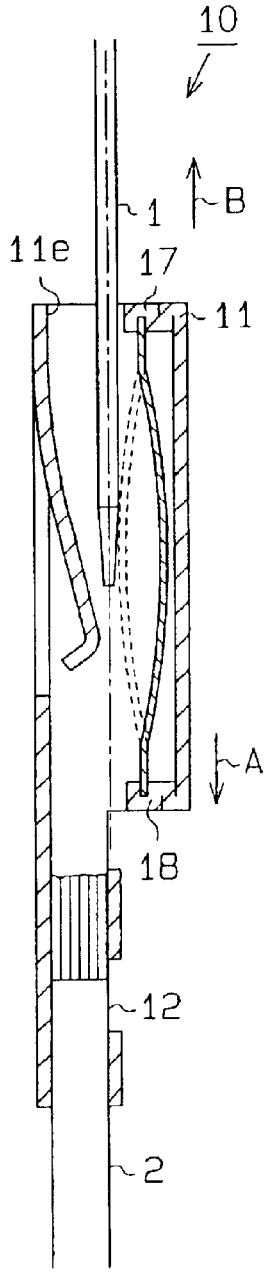
Figure 4A:
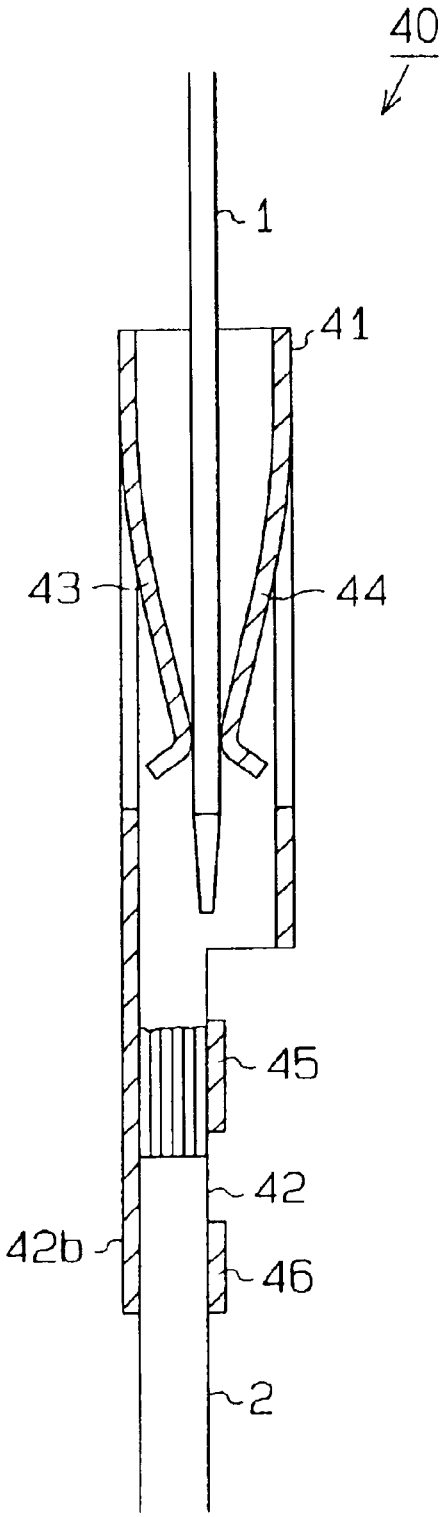
FIG. 4(*a*) is a cross-sectional view of a prior art solderless terminal when a prong of a male terminal is completely inserted.
Figure 4B:
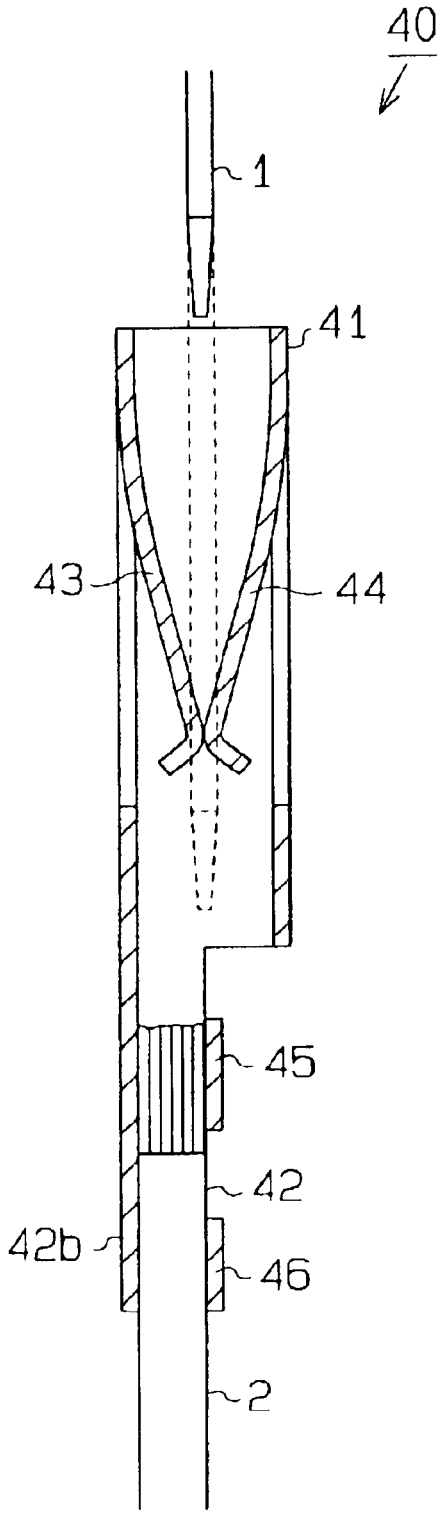
Figure 5:
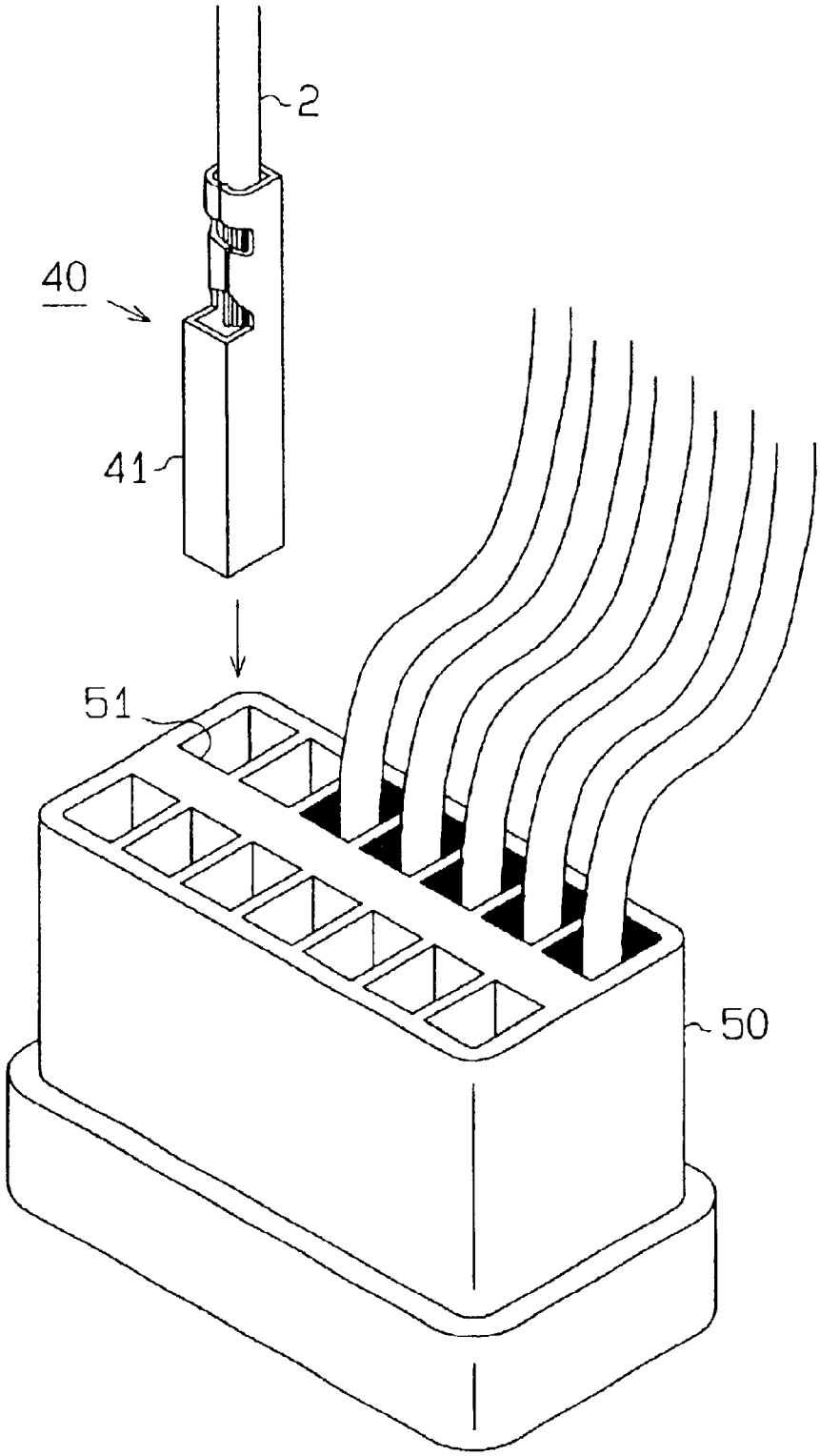
FIG. 5 is a perspective view showing the prior art solderless terminal of FIG. 4(*a*) inserted in a connector housing.

As shown in FIG. 3(*a*), the prong 1 may be moved in directions A and B. The direction A refers to a direction for inserting the prong 1 into the receptacle 11. The direction B refers to a direction for removing the prong 1 out of the receptacle 11. The prong 1 is inserted from the opening 11*e* in the direction A along the axis of the terminal main body 10. The insertion of the prong 1 is completed when the prong 1 reaches a point close to the lug 12. In this state, the prong 1 contacts the first contact point 13*a* of the main contactor 13 and the second contact point 14*a* of the auxiliary contactor 14. The first contact point 13*a* and the second contact point 14*a* are pressed against the prong 1 by elastic forces. The auxiliary contactor 14 has a higher electrical resistance than the main contactor 13. Thus, when the prong 1 is completely inserted in the receptacle 11, current flows from the terminal main body 10 to the prong 1 through the first contact point 13*a* of the main contactor 13.

When removing the prong 1 out of the opening 11*e* of the receptacle 11, the prong 1 is slowly moved in the direction B as shown in FIG. 3(*b*). In this embodiment, the second contact point 14*a* of the auxiliary contactor 14 is closer to the opening 11*e* than the first contact point 13*a* of the main contactor 13. The distance between the first contact point 13*a* and the second contact point 14*a* in the longitudinal direction of the receptacle 11 is about one twentieth to one fifth of the length b of the receptacle. Therefore, after being separated from the first contact point 13*a*, the prong 1 remains contacting the second contact point 14*a*. Further, the supports 17, 18, which support the auxiliary contactor 14 at the ends, are formed by bending the ends of the upper 11*a* of the receptacle 11, which is made of conductive metal. Thus, after the prong 1 is separated from the first contact point 13*a*, the terminal main body 10 remains electrically connected to the prong 1 at the second contact point 14*a* of the auxiliary contactor 14.

Before being deformed, the auxiliary contactor 14 is formed like a diaphragm bulging toward the axis of the terminal main body 10 as illustrated by broken lines in FIG. 3(*c*). The auxiliary contactor 14 supported by the supports 17, 18 at the ends. When electrically the auxiliary contactor 14 is connected with the prong 1 through the second contact point 14*a*, electrical current passes through the auxiliary contactor 14. At this time, the auxiliary contactor 14 produces heat due to electrical resistance. Since the auxiliary contactor 14 is formed with two different metal, the auxiliary contactor 14 is bulged at the side of the low thermal expansion coefficient metal 14*b*, or away from axis of the main body 10. Therefore, the curvature of the auxiliary contactor 14 is reversed about the supports 17, 18, and the auxiliary contactor 14 is displaced away from the prong 1. The change of the curvature separates the auxiliary contactor 14 from the prong 1. Arc is thus produced at the second contact point 14*a* of the auxiliary contactor 14.

The present embodiment has the following advantages.

(1) When removing the prong 1 of the male terminal from the terminal main body 10, the prong 1 remains contacting the second contact point 14*a* of the auxiliary contactor 14 after being separated from the first contact point 13*a* of the main contactor 13. In this state, since the prong 1 remains electrically connected to the terminal main body 10 through the second contact point 14*a*, arc is prevented at the first contact point 13*a*. The first contact point 13*a* and the corresponding surface of the prong 1 are not roughened by arc. That is, the contact resistance between the first contact point 13*a* and the prong 1 is not increased, and production of heat due to electrical resistance is suppressed at the first contact point 13*a*. Therefore, if applied to the female connector housing, the solderless terminal main body 10 does not degrades the connector housing even if the an electrical load is connected with a high-voltage power supply. The reliability of the terminal main body 10 is improved.

(2) After the prong 1 separated from the fist contact point 13*a* and electrically connected only with the auxiliary contactor 14, electric current passes through the auxiliary contactor 14. Then, the auxiliary contactor 14 is heated in an extremely short time and deformed away from the prong 1. The auxiliary contactor 14 is deformed to be separated from the prong 1. Arc is thus produced at the second contact point 14*a* of the auxiliary contactor 14. However, since the auxiliary contactor 14 is deformed to be separated from the prong 1, the arc produced at the second contact point 14*a* is suppressed. The second contact point 14*a* and the corresponding surface of the prong 1 are not significantly roughened by the arc. The reliability of the terminal main body 10 is therefore further improved.

(3) When supplied with electric current, the diaphragm shaped auxiliary contactor 14 is deformed away from the prong 1 of the male terminal. Therefore, since the contactor 14 is supported at the ends by the supports 17, 18, the curvature of the auxiliary contactor 14 is reversed about the supports 17, 18, and the auxiliary contactor 14 is displaced away from the prong 1. This increases the speed at which the second contact point 14*a* is separated from the prong 1 and thus shortens the time taken for sweeping arc. Therefore, the arc produced at the second contact point 14*a* is further suppressed. As a result, the second contact point 14*a* and the corresponding surface of the prong 1 are less roughened by the arc. The reliability of the terminal main body 10 is therefore further improved.

(4) The auxiliary contactor 14 is formed by bonding two metals having different thermal expansion coefficient and is deformed away from the axis of the terminal main body 10 when heated. After dissipating heat by itself, the auxiliary contactor 14 returns to the original shape. Therefore, the number of parts in the terminal main body 10 is reduced, and the size of the main body 10 is reduced.

(5) The diaphragm shaped auxiliary contactor 14 is supported at the upper wall 11*a* of the receptacle 11 with both ends held by the supports 17, 18. Compared to a case in which the contactor 14 is supported at one end, the contactor 14 is pressed against the prong 1 by a greater stress. In other words, the auxiliary contactor 14 is strongly pressed against the prong 1 at the second contact point 14*a,* which is the peak of the curved portion. Therefore, the contact pressure between the contactor 14 and the prong 1 is increased by holding the contactor 14 at both ends.

(6) The main contactor 13 and the auxiliary contactor 14 face each other with the prong 1 in between. Therefore, the prong 1 is held by the contactors 14, 13 at the side of the upper wall 11*a* and the lower wall 11*b* of the receptacle 11. Thus, the contactors 13, 14 are elastically pressed against the prong 1, and the contact pressure between the contactors 13, 14 and the prong 1 is sufficient. This structure does not increases the contact resistance between each of the contactors 13, 14 and the prong 1. The reliability of the terminal main body 10 is therefore improved.

It should be apparent to those skilled in the art that the present invention may be embodied in many other specific forms without departing from the spirit or scope of the invention. Particularly, it should be understood that the invention may be embodied in the following forms.

In the embodiment of FIGS. 1(*a*) to 3(*c*), the terminal main body 10 has a rectangular cross-section. However, the terminal main body 10 may have a substantially circular cross-section or a U-shaped cross-section. Alternatively, the terminal main body 10 may be formed as a flat plate.

In the embodiment of FIGS. 1(*a*) to 3(*c*), the main contactor 13 is integrally formed with the lower wall 11*b* of the receptacle 11. However, the main contactor 13 may be formed by attaching a separately formed conductive metal piece to the lower wall 11*b* of the receptacle 11.

In the embodiment of FIGS. 1(*a*) to 3(*c*), the main contactor 13 is formed as a metal plate. However, the main contactor 13 need not be formed as a metal plate. For example, the main contactor 13 may be a projection made of conductive metal.

In the embodiment of FIGS. 1(*a*) to 3(*c*), the auxiliary contactor 14 is formed by boding two different metal plates having different thermal expansion coefficients. However, the auxiliary contactor 14 may be formed by boding three or more metal plates having different thermal expansion coefficients.

In the embodiment of FIGS. 1(*a*) to 3(*c*), the auxiliary contactor 14 is supported at both ends by the supports 17, 18. However, the support 17, which located at the opening 11*e,* may be omitted.

The main contactor 13 and the auxiliary contactor 14 face each other with the prong 1 in between. However, the main contactor 13 and the auxiliary contactor 14 need not face each other with the prong 1 in between. Specifically, the main contactor 13 and the auxiliary contactor 14 may be located on one of the upper wall 11*a,* the lower wall 11*b,* and the sidewalls 11*c,* 11*d* of the receptacle 11. Alternatively, the main contactor 13 and the auxiliary contactor 14 may be located on two of the walls 11*a* to 11*d* that do not face each other.

In the embodiment of FIGS. 1(*a*) to 3(*c*), the peak of the bulge of the diaphragm shaped auxiliary contactor 14 functions as the second contact point 14*a.* However, a separately formed metal piece may be attached to the peak of the curved portion of the auxiliary contactor 14 and function as the second contact point 14*a.*

Therefore, the present examples and embodiments are to be considered as illustrative and not restrictive and the invention is not to be limited to the details given herein, but may be modified within the scope and equivalence of the appended claims.

What is claimed is:

1. A high-voltage terminal for connecting a high-voltage power supply with a male terminal extending from an electric component, comprising:

an elongated hollow housing made of a conductive material, wherein the housing includes an opened first end for receiving the male terminal, and a second end connected to the power supply;

a first contactor made of a conductive material, wherein first contactor is located in the housing, and wherein, when the male terminal is inserted into the housing, the first contactor contacts the male terminal; and a second contactor made of a conductive material, wherein the second contactor is located in the housing at a position closer to the first end than the first contactor is, wherein, when the housing receives the male terminal, the second contactor contacts the male terminal and is deformed by arc generated by the contact with the male terminal;

wherein the second contactor is curved to protrude inward of the housing, wherein the second contactor includes a first conductive metal portion and a second conductive metal portion, wherein the first conductive metal portion contacts the male terminal inserted into the housing, wherein the second conductive metal portion is attached to the first conductive metal portion, and wherein the thermal expansion coefficient of the second conductive metal portion is different from the thermal expansion coefficient of the first conductive metal portion;

whereby, when the male terminal is removed from the housing, the second contactor is deformed to separate from the male terminal after the male terminal is separated from the first contactor.

2. The high-voltage terminal according to claim 1:

wherein the housing has an inner wall; and wherein the first contactor is made of the same material as the housing and is shaped into a plate, and wherein the first contactor protrudes inward of the housing from the inner wall of the housing.

3. The high-voltage terminal according to claim 2:

wherein the second contactor protrudes from the inner wall of the housing in a direction facing the first end at a position closer to the first end than the first contactor is.

4. The high-voltage terminal according to claim 1, wherein the thermal expansion coefficient of the first conductive metal portion is greater than the thermal expansion coefficient of the second conductive metal portion.

5. The high-voltage terminal according to claim 1, wherein the ends of the second contactor are supported in the vicinities of the first and second ends of the housing, respectively.

6. A high-voltage terminal for connecting a high-voltage power supply with a male terminal extending from an electric component, comprising:

an elongated hollow housing made of a conductive material, wherein the housing includes an opened first end, into which the male terminal is inserted, and a second end, to which the power supply is connected;

a first contactor made of a conductive material, wherein the first contactor is located in the housing, and wherein, when the male terminal is inserted into the housing, the first contactor contacts the male terminal; and a second contactor made of a conductive material, wherein the second contactor is located in the housing at a position closer to the first end than the first contactor is, and wherein, when the male terminal is inserted into the housing, the second contactor contacts the male terminal is deformed by arc generate by the contact with the male terminal;

wherein the housing has an inner wall;

wherein the first contactor is made of the same material as the material of the housing and is shaped into a plate, and wherein the first contactor protrudes inward of the housing from the inner wall of the housing; and wherein the second contactor is curved to protrude from the inner wall of the housing in a direction facing the first end at a position closer to the first end than the first contactor is, wherein the second contactor includes a first conductive metal portion and a second conductive metal portion, wherein the first conductive metal portion contacts the male terminal inserted into the housing, wherein the second conductive metal portion is attached to the first conductive metal portion, and wherein the thermal expansion coefficient of the second conductive metal portion is different from the thermal expansion coefficient of the first conductive metal portion.

7. The high-voltage terminal according to claim 6, wherein the thermal expansion coefficient of the first conductive metal portion is greater than the thermal expansion coefficient of the second conductive metal portion.

8. The high-voltage terminal according to claim 6, wherein the ends of the second contactor are supported in the vicinities of the first and second ends of the housing, respectively.

9. A high-voltage terminal for connecting a high-voltage power supply with a male terminal extending from an electric component, comprising:

an elongated hollow housing made of a conductive material, wherein the housing includes an opened first end for receiving the male terminal, and a second end connected to the power supply;

a first contactor made of a conductive material, wherein the first contactor is located in the housing, and wherein, when the male terminal is inserted into the housing, the first contactor contacts the male terminal;

a second contactor made of a conductive material, wherein the second contactor is located in the housing at a position closer to the first end than the first contactor is, wherein, when the housing receives the male terminal, the second contactor contacts the male terminal and is deformed by arc generated by the contact with the male terminal;

whereby, when the male terminal is removed from the housing, the second contactor is deformed to separate from the male terminal after the male terminal is separated from the first contactor;

wherein the housing has an inner wall;

wherein the first contactor is made of the same material as the housing and is shaped into a plate, and wherein the first contactor protrudes inward of the housing from the inner wall of the housing;

wherein the second contactor protrudes from the inner wall of the housing in a direction facing the first end at a position closer to the first end than the first contactor is; and wherein the second contactor is curved to protrude inward of the housing, wherein the second contactor includes a first conductive metal portion and a second conductive metal portion, wherein the first conductive metal portion contacts the male terminal inserted into the housing, wherein the second conductive metal portion is attached to the first conductive metal portion, and wherein the thermal expansion coefficient of the second conductive metal portion is different from the thermal expansion coefficient of the first conductive metal portion.

10. The high-voltage terminal according to claim 9, wherein the thermal expansion coefficient of the first conductive metal portion is greater than the thermal expansion coefficient of the second conductive metal portion.

11. The high-voltage terminal according to claim 9, wherein the ends of the second contactor are supported in the vicinities of the first and second ends of the housing, respectively.

* * * * *